US006364737B1

(12) United States Patent
Sterr et al.

(10) Patent No.: US 6,364,737 B1
(45) Date of Patent: Apr. 2, 2002

(54) LIGHTWEIGHT MATERIAL PROJECTION SYSTEM

(75) Inventors: Ardina K. Sterr, Sherman Oaks; S. Clark Bason, Palm Springs; Noah Winter, Valencia, all of CA (US)

(73) Assignee: Artistry In Motion, Inc., Van Nuys, CA (US)

( * ) Notice: Subject to any disclaimer, the term of this patent is extended or adjusted under 35 U.S.C. 154(b) by 0 days.

(21) Appl. No.: 09/548,799

(22) Filed: Apr. 14, 2000

(51) Int. Cl.[7] ..... A63H 37/00
(52) U.S. Cl. ..... 446/475; 124/74
(58) Field of Search ..... 124/79; 446/475, 446/483, 481, 487, 491

(56) References Cited

U.S. PATENT DOCUMENTS

| | | | | |
|---|---|---|---|---|
| 4,593,622 | A | | 6/1986 | Fibranz |
| 4,791,870 | A | | 12/1988 | Simpson |
| 5,015,211 | A | * | 5/1991 | Reveen |
| 5,149,290 | A | * | 9/1992 | Reveen |
| 5,304,096 | A | | 4/1994 | Wilk |
| 5,512,003 | A | | 4/1996 | Parker |
| 5,634,840 | A | | 6/1997 | Watkins |
| 5,954,563 | A | | 9/1999 | Spriggs |
| 6,149,495 | A | * | 11/2000 | Austin et al. |

OTHER PUBLICATIONS

Internet Web Pages from Artistry In Motion, Inc.; <www.artistryinmotion.com/cannons.html>, printed Mar. 28, 2000.
Internet Web Pages from Aerotechnics; <www.aerotechnic-.com/cannon1.html>, printed Mar. 28, 2000.
Internet Web Pages from Aerotechnics; <www.aerotechnic-.com/cannon2.html>, printed Mar. 28, 2000.
Internet Web Pages from Aerotechnics; <www.aerotechnic-.com/cannon3.html>, printed Mar. 28, 2000.
Internet Web Pages from Aerotechnics; <www.aerotechnic-.com/cannon4.html>, printed Mar. 28, 2000.
Internet Web Pages from Aerotechnics; <www.aerotechnic-.com/cannon5.html>, printed Mar. 28, 2000.
Internet Web Pages from Aerotechnics; <www.aerotechnic-.com/cannon6.html>, printed Mar. 28, 2000.
Internet Web Pages from Aerotechnics; <www.aerotechnic-.com/cannon7.html>, printed Mar. 28, 2000.
Internet Web Pages from Aerotechnics; <www.aerotechnic-.com/cannon8.html>, printed Mar. 28, 2000.
Internet Web Pages from Aerotechnics; <www.aerotechnic-.com/cannon9.html>, printed Mar. 28, 2000.
Internet Web Pages from Aerotechnics; <www.aerotechnic-.com/cannon10.html>, printed Mar. 28, 2000.
Internet Web Pages from Aerotechnics; <www.aerotechnic-.com/cannon11.html>, printed Mar. 28, 2000.

(List continued on next page.)

*Primary Examiner*—Charles T. Jordan
*Assistant Examiner*—Troy Chambers
(74) *Attorney, Agent, or Firm*—Lyon & Lyon LLP

(57) ABSTRACT

The present invention is directed, in a first aspect, to a lightweight material projection system that can be stored and transported in a space-efficient manner. In one embodiment of the invention, the lightweight material projection system comprises a storage housing assembly for storing a lightweight material projector, a force supplying apparatus, and a lightweight material projector having an ejection member. The storage housing assembly comprises a base assembly and a cover assembly, wherein during use, the cover assembly is removed and the ejection member of the projector is connected to the base assembly of the storage housing assembly.

Another aspect of the invention involves the use of the base assembly as a passage way for lightweight materials using non-electrical force supplying apparatus. In a preferred embodiment, the lightweight materials are projected using a venturi vacuum.

19 Claims, 4 Drawing Sheets

OTHER PUBLICATIONS

Internet Web Pages from Aerotechnics; <www.aerotechnic-.com/cannon12.html>, printed Mar. 28, 2000.
Internet Web Pages from Aerotechnics; <www.aerotechnic-.com/cups.html>, printed Mar. 28, 2000.
Internet Web Pages from Aerotechnics; <www.aerotechnic-.com/new.html>, printed Mar. 28, 2000.
Internet Web Pages from Bill Ferrel Co.; <www.billferrel-.com/confetti.html>, printed Mar. 28, 2000.
Internet Web Page from Sigma Services;<www.sigmaservices.com/confetti.html>, printed Jul. 21, 2000.

* cited by examiner

LIGHTWEIGHT MATERIAL PROJECTION SYSTEM

FIELD OF THE INVENTION

The present invention relates to the field of devices for projecting lightweight materials.

BACKGROUND OF THE INVENTION

Festive occasions such as birthday, wedding, Christmas and New Year's Eve celebrations often employ the use of lightweight materials that are projected into the air to create pleasing visual effects. They are also used as visual effects for stage shows, rock concerts, conventions, and parades. These lightweight materials, in general, create an atmosphere of festivities and excitement for partygoers and/or spectators.

Common examples of these lightweight materials include confetti, streamers, glitters, plush balls, foam shapes, etc. Confetti is often created from paper or polyvinyl film that is cut into different shapes, styles, and sizes. Confetti can also be made in a variety of different colors and shapes. Streamers are long strips of paper or polyvinyl film that are curled up into rolls. As by the confetti and/or the streamers are projected into the air, they scatter and fall creating a pleasing visual effect.

At small events, these lightweight materials can be projected by hand or a handheld device. But at larger events, particularly those that are held in wide areas, a specialized projector may be required. The projector such as a confetti cannon often makes use of an ejection member forming the barrel of the cannon. At the base of the barrel is a force supplying apparatus such as a motorized fan, gun-powder-explosive system, or compressed air from a pressurized canister.

The larger the event, the greater is the need for larger projectors. The use of larger projectors, however, decreases the ease of moving, storing, shipping, and handling them. Also, the projector containers can be bulky and take up valuable space in storage or on the stage, particularly when the projectors are being used. Thus, there exists a need for an easy to handle and store, space-saving lightweight-material projector and container.

SUMMARY OF THE INVENTION

The present invention is directed, in a first aspect, to a lightweight material projection system that can be stored and transported in a space-efficient manner. In one embodiment of the invention, the lightweight material projection system comprises a lightweight material projector having an ejection member, a force supplying apparatus, and a storage housing assembly for storing the lightweight material projector. The storage housing assembly comprises a base assembly and a cover assembly, wherein the ejection member of the projector is connected to the the base assembly of the storage housing assembly.

Another aspect of the invention involves the use of the base assembly as a passage way for lightweight materials using non-electrical force supplying apparatus. In a preferred embodiment, the lightweight materials are projected using a venturi vacuum.

DETAILED DESCRIPTION OF PREFERRED EMBODIMENTS OF THE INVENTION

Figure 1:
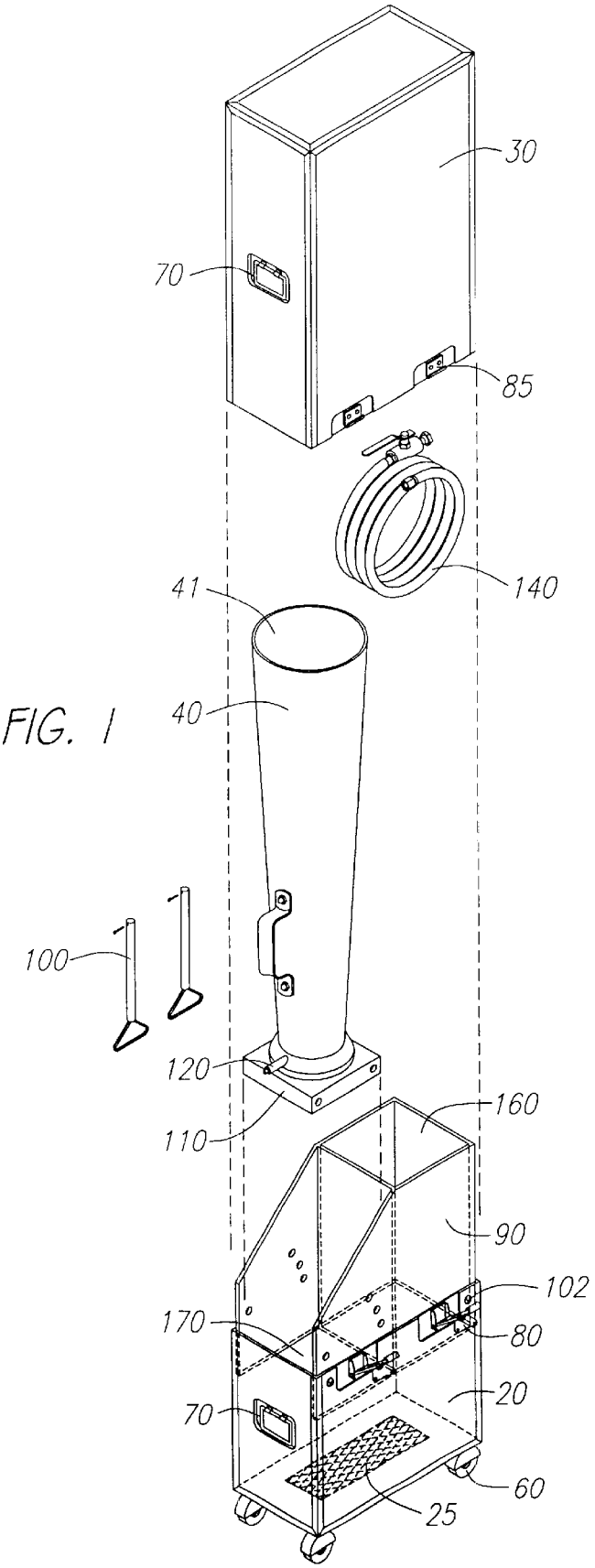
FIG. 1 shows an exploded perspective view of the lightweight-material projector arranged for storage according to one embodiment of the present invention.
Figure 2:
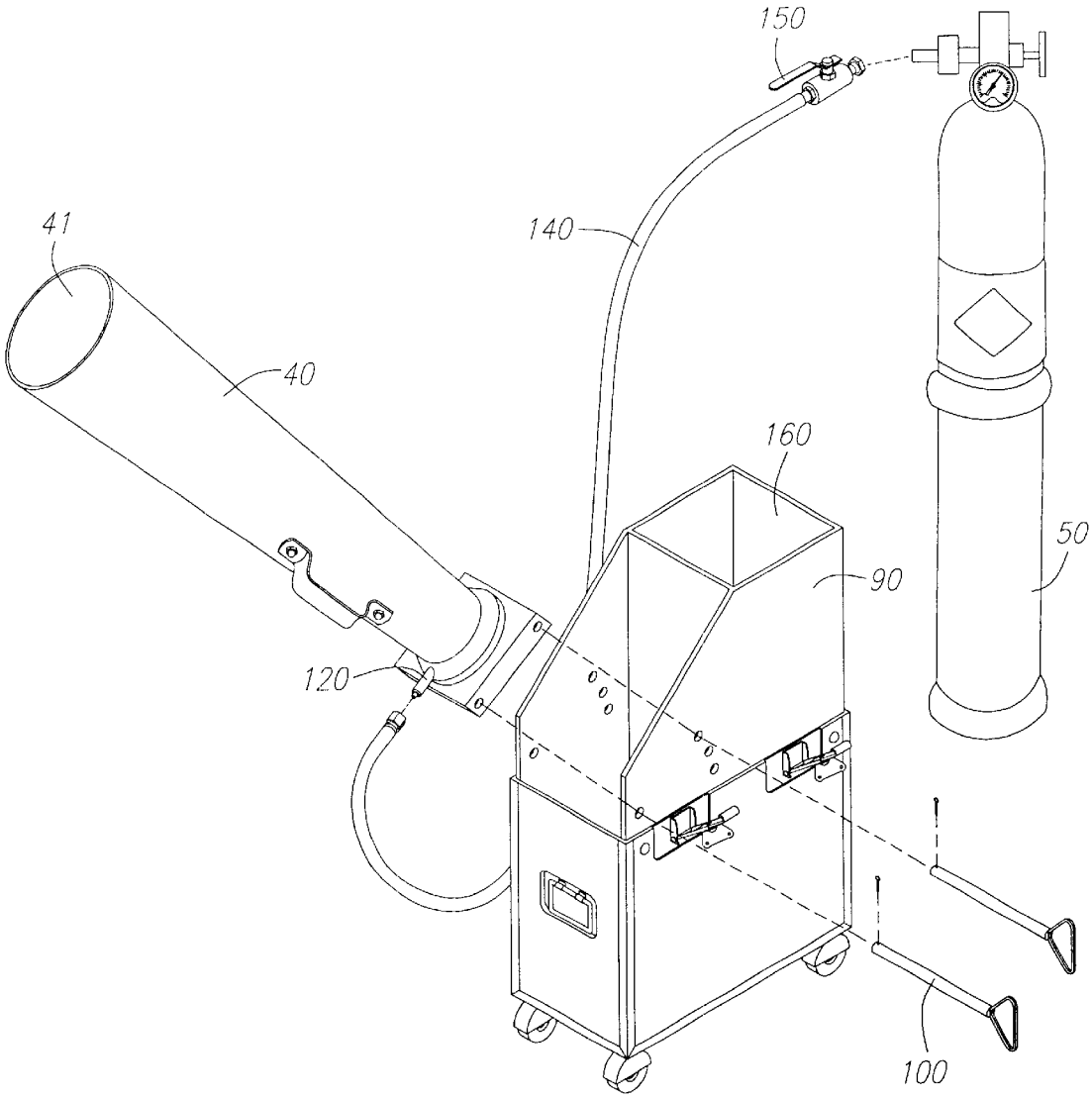
FIG. 2 shows an exploded perspective view of the lightweight-material projector arranged for use according to one embodiment of the present invention.
Figure 3:
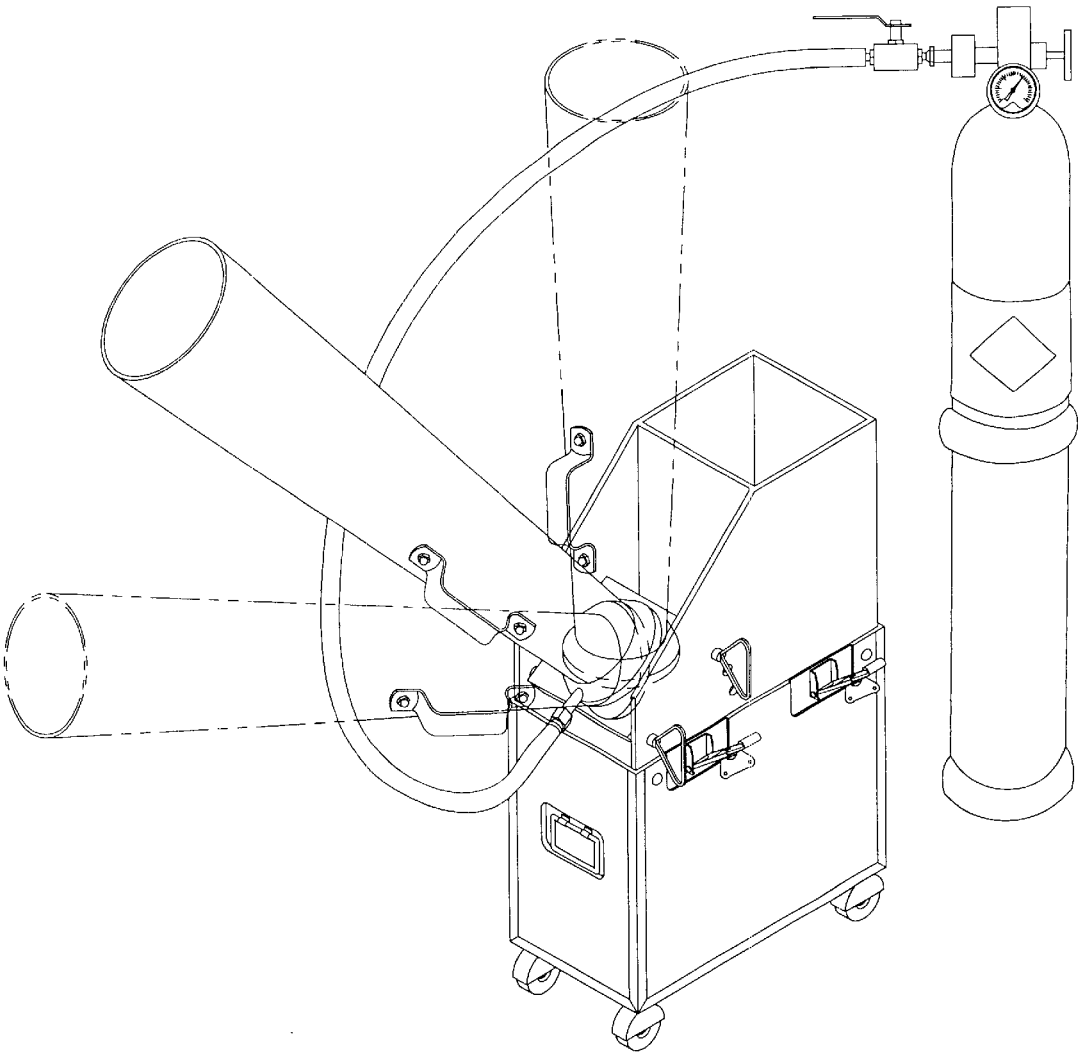
FIG. 3 shows a perspective view of the lightweight-material projector assembled according to one embodiment of the present invention.

FIG. 1–3 depict one embodiment of the present invention. This embodiment comprises a storage housing assembly with a base assembly 20 and a cover assembly 30. Within this storage housing assembly is stored at least some of the components for the lightweight-material projector. These components include an ejection member, preferably a barrel 40 or other elongated tubular shape structure. The lightweight material projection system can further include at least one coupling member 90 and at least one securing member 100 for installing the projector.

FIG. 1 shows an arrangement of the components for a lightweight-material projector within a storage housing assembly that encloses the projector in a compact and space-efficient manner according to one embodiment of the invention. In this embodiment, the base assembly and the cover assembly 30 are empty boxes each having an open cavity. The base assembly and the cover assembly are detachable from each other. They can be made from wood, fiberglass, and metal, and are conventionally known in the art as "road cases". The inner walls and the inner base or floor of the base assembly are lined with fiberglass; the base assembly also includes a grided opening 25 at its base or floor. In one embodiment, the base assembly, preferably, is 19 inches long, 10½ inches wide, and 13½ inches high, and the cover assembly is 19 inches long, 10½ inches wide, and 23½ inches high. In another preferred embodiment, the base assembly is 26 inches long, 14¾ inches wide, and 17½ inches high, and the cover assembly is 26 inches long, 14¾ inches wide, and 31½ inches high.

The storage housing assembly can include at least one locking apparatus for securing the base assembly and the cover assembly. The locking apparatus can include a first retractable clamp 80 attached to the base assembly via a hinge with a corresponding second non-retractable clamp 85 on the cover assembly. Once the first retractable clamp and second non-retractable clamp are interlocked, they can be tightened to secure the base assembly and cover assembly via retracting the first retractable clamp. Alternatively, the locking apparatus can be a simple U-shaped structure on the base assembly. This structure is capable of mating with a comparably sized slit on a hinged plate attached to the cover assembly. This latter locking apparatus is commonly used for securing an object with a padlock.

The storage housing assembly can further include at least one mobility apparatus for ease of transport and at least one handling apparatus for ease of handling. The mobility apparatus preferably includes wheels 60 with a braking system but can also include sleds, rollers, or other friction reducing apparati instead. The handling apparatus preferably includes at least one U-shaped shaped bar 70 pivotally attached to at least one side or wall of the base assembly 20 or the cover assembly 30. The U-shaped bar 70 can also be cushioned for comfort either by rubber or other means.

FIG. 2 illustrates the assembly of one embodiment of the present invention. Generally, the base assembly 20 forms the base support for the lightweight-material projector. A coupling member 90 can be used to connect the ejection member, such as a barrel 40, to the base assembly using securing members 100. In a preferred embodiment, the coupling member can be made out of any rigid material such as wood, metal, plastic, etc. and preferably attached to the base with another set of securing members 102 such as rivets, screws, or pins. The coupling member can also be constructed to simply stand inside the base assembly; it can also be constructed with wings along its sides that allow it to rest on the mouth of the base assembly without any securing members. Alternatively, for ease of assembly, the coupling member can be an integral part of the base assembly either constructed as a continuous extension of the walls of the base assembly or already pre-attached to the base assembly by securing means 102 as shown in FIGS. 1–3.

The coupling member 90 can include a feeder port 160 and an ejection port 170. The feeder port 160 is used for ease and continuous loading of the projector. In FIGS. 1–3, the feeder port 160 is shown as an opening located on the coupling member 90, while the ejection port 170 is the site where the barrel 40 is connected to the coupling member.

FIG. 2 also shows one embodiment of the ejection member as a barrel 40 having an exit port 41 and an entry port. The exit port's diameter is wider than the entry port's diameter forming a conical shaped horm. The barrel can be constructed from any rigid material such as wood, metal, plastic, etc. Depending on the need, the ejection member can be constructed to be long or short with wide or narrow openings. The longer the ejection member and narrower the openings, the farther it can project the lightweight materials. The wider the openings, however, the greater the amount of materials it can deliver. In one preferred embodiment, the ejection member is a conical shaped horn having a length of thirty four (34) inches, a bottom inside diameter of 3½ inches, and a top inside diameter of 6¾ inches. In another preferred embodiment, the conical shaped horn has a length of forty six (46) inches, a bottom inside diameter of 6¼ inches, and a top inside diameter of 12¼ inches.

In another embodiment of the invention, the ejection member's length is adjustable. It is made up of at least two concentric conical tubes where the first concentric conical tube extends away from the second concentric conical tube. Part of the concentric conical tubes, however, overlap with the first and second concentric conical tubes forming a continuous hollow tube. In this overlapping area, securing members such as screws, pins, ball and detent system, can be employed to hold the concentric tubes together. In the ball and detent system, for example, at least two ball-like protrusions can be molded on the inner circumference of the first concentric conical tube. These ball-like protrusions, in turn, can lock into indentations along lateral grooves on the outer circumference of the second concentric conical tube. Preferably, the inner circumference at the base of the first concentric conical tube is just slightly larger than the outer circumference at the top of the second concentric conical tube. Thus, when the first concentric conical tube is extended away from the second concentric conical tube, the two concentric conical tubes fit snugly at the overlapping area and may not necessarily require securing members.

In a preferred embodiment, the ejection member such as a barrel 40 may include a base plate 110 surrounding the outside perimeter of the barrel 40. The base plate may include two sets of openings that match with sets of openings in the coupling member or the base assembly. These openings allow for securing the ejection member to the coupling member using securing members 100 such as rivets, screws, pins, etc. which are inserted into the openings. The openings can be provided to allow for securing the ejection member at a certain trajectory angle depending on the need of the occasion. In addition, to allow changes in the trajectory angle, one of the securing members anchors the ejection member at a pivot point while the other securing member can be removed and replaced into other sets of openings in the coupling member. The angle may be any angle, but preferably ranging from 45° to 90°.

Figure 4:
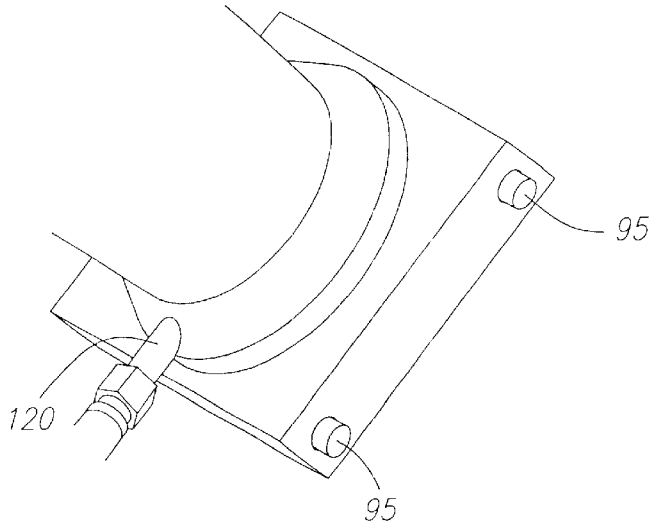
FIGS. 4–6 show perspective views of alternative methods of assembling the lightweight material projector according to one embodiment of the present invention.
Figure 5:
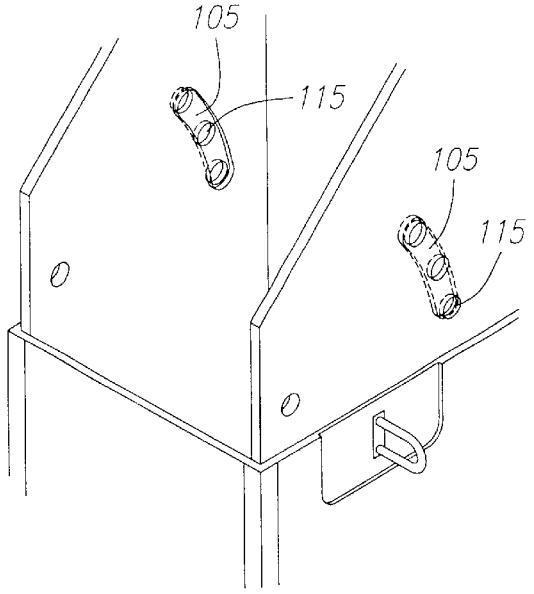
Figure 6:
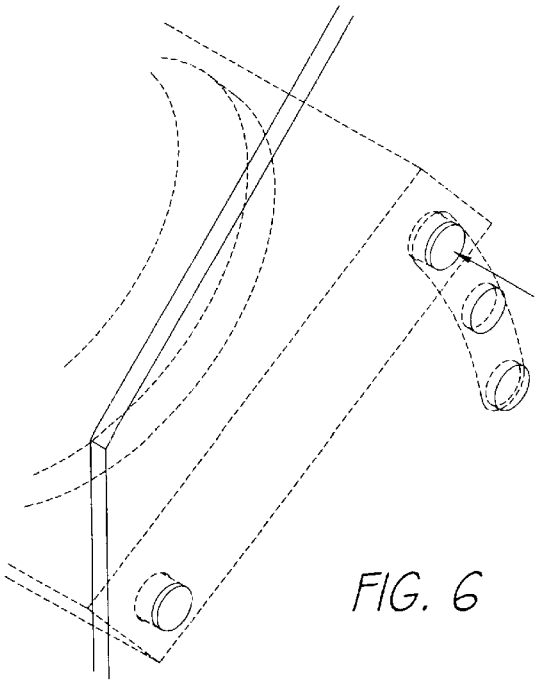

Alternatively, instead of having openings, the base plate can include two sets of retractable pins 95 supported with torsional springs. One set of the retractable pins or balls secures the ejection member at a pivot point while the other set runs along groves 105 on the coupling member 90. (See FIGS. 4–6). This allows for changes in trajectory angle by simply retracting this latter set of pins or balls, adjusting the angle of the ejection member, and reseating the pins in another set of pre-drilled openings 115. In a preferred embodiment, these retractable pins 95 are in the shape of a ball. These retractable balls, also supported by torsional springs, To lock into indentations along the coupling member instead of pre-drilled openings and grooves. To change the trajectory angle, force is applied on the ejection member to retract the balls and to slide them out of the indentations into another set of indentations. In these embodiments, the ejection member can be attached to the base assembly even during storage in the storage housing assembly; the ejection member can be pivotally positioned to point upwards with the cover assembly covering the projector. To minimize the size of the storage housing assembly, the ejection member can be adjustable in length as described above.

In another preferred embodiment of the invention, the base plate further includes an intake port 120 for receiving part of a force supplying apparatus. The force supplying apparatus employ compressed gas coming from a pressurized canister 50, preferably compressed air or compressed $C_2$. A hose 140 runs from the pressurized canister 50 to the intake port 120. This hose 140 can include an on/off control valve 150 to control the airflow. A pressure controller hooked up to the canisters can also control the pressure of the gas. The pressure can be set for an optimal force to project the appropriate amount of lightweight materials to a certain height and distance.

To use the preferred embodiment of the invention, the base assembly is initially loaded with a minimal amount of lightweight materials. Pressure from the pressurized canister is set at a range from 60 to 1800 psi., preferably at 1800 psi. At the appropriate time, the gas is released from the canister and delivered into the base of the ejection member creating a venturi vacuum that pulls the lightweight materials from the base assembly, through the ejection port 170, into the ejection member, and out of the exit port 41 of the ejection member. The lightweight materials in the base assembly are replenished by feeding more materials through the feeder port 160. Thus, a continuous flow of lightweight materials fed into the feeder port is pulled through the cavity within the base assembly, into and out of the ejection member. This continuous projection of lightweight materials, in turn, creates a pleasing visual effect as the lightweight materials scatter and fall.

While specific embodiments of the present invention have been disclosed and described, it would be apparent to those skilled in the art that the invention can be modified in arrangement and detail without departing from the spirit of the present invention. As such, it should be recognized that the detailed embodiment is illustrative only and should not be taken as limiting the scope of the present invention.

What is claimed is:

1. A lightweight material projection system comprising:

a storage housing assembly for storing a lightweight material projector, wherein the storage housing assembly comprises a base assembly detachably connectable to a cover assembly;

a force supplying apparatus;

wherein the lighitweight material projector comprises an ejection member connected to the base assembly; and wherein the lightweight material is selected from a group consisting of confetti, streamers, glitters, plush balls, and foam shapes.

2. The ligahtweight material projection system in claim 1 further comprising:

a coupling member that connects the ejection member to the base assembly.

3. The lightweight material projection system in claim 1 further comprising a feeder port attached to the base assembly.

4. The lightweight material projection system in claim 1 further comprising a coupling member that connects the ejection member to the base assembly; and a feeder port that forms a part of the coupling member.

5. The lightweight material projection system in claim 1 wherein the ejection member is detachably connected to the base assembly.

6. The lightweight material projection system in claim 1 wherein the ejection member is connected to the base assembly to form a trajectory angle.

7. The lightweight material projection system in claim 6 wherein the ejection member is pivotally connected to the base assembly to allow for variation of the trajectory angle.

8. The lightweight material projection system in claim 1 wherein the base assembly includes a mobility apparatus.

9. The lightweight material projection system in claim 8 wherein the mobility apparatus comprises at least one wheel.

10. The lightweight material projection system in claim 1 wherein the force supplying apparatus does not use electricity.

11. The lightweight material projection system in claim 1 wherein the force supplying apparatus uses compressed gas to project lightweight materials.

12. The lightweight material projection system in claim 11 wherein the compressed gas is $CO_2$.

13. The lightweight material projection system in claim 1 wherein the ejection member comprises an exit port and an entry port, wherein the exit port is wider than the entry port.

14. A lightweight material projection system comprising:

an ejection member connected to a non-electrical force supplying apparatus;

a base assembly connected to the ejection member, wherein the base assembly is used as a passage way for lightweight materials being projected out of the ejection member;

a cover assembly detachably connectable with the base assembly that together forms a storage housing for the ejection member; and wherein the lightweight material is selected from a group consisting of confetti, streamers, glitters, plush balls, and foam shapes.

15. The lightweight material projection system in claim 14 wherein the force supplying apparatus creates a venturi vacuum to project the lightweight materials.

16. Tile lightweight material projection system in claim 14 further comprising:

a coupling member that connects the base assembly to the ejection member, wherein the coupling member includes a feeder port for feeding lightweight materials to the lightweight material projection system.

17. A storage housing assembly for storing a projector of lightweight material, the storage housing assembly comprising:

a cover assembly and a base assembly;

wherein the cover assembly is removed during use of the projector;

wherein the base assembly forms a base support for the projector during use; and wherein the lightweight material is selected from a group consisting of confetti, streamers, glitters, plush balls, and foam shapes.

18. The storage housing assembly in claim 17 further comprises a coupling member having a feeder port and an ejection port, wherein the coupling member is connected to the base assembly.

19. The storage housing assembly in claim 18 wherein the projector comprises:

an ejection member detachably connectable to the ejection port;

a force supplying apparatus detachably connectable to the ejection member; and wherein the ejection member may be contained in the feeder port or the ejection port of the coupling member when stored in the storage housing assembly.

* * * * *

UNITED STATES PATENT AND TRADEMARK OFFICE

CERTIFICATE OF CORRECTION

PATENT NO. : 6,364,737 B1 
DATED : April 2, 2002
INVENTOR(S) : Ardina K. Ster, S. Clark Bason and Noah Winter It is certified that error appears in the above-identified patent and that said Letters Patent is hereby corrected as shown below:

Column 5,
Line 8, “lighitweight” should be -- lightweight --;
Line 13, “ligahtweight” should be -- lightweight --.

Signed and Sealed this

Seventeenth Day of June, 2003

JAMES E. ROGAN
*Director of the United States Patent and Trademark Office*